US005218742A

United States Patent [19]

Sleven

[11] Patent Number: 5,218,742

[45] Date of Patent: Jun. 15, 1993

[54] CLIP CLOSURE FOR BAGS

[75] Inventor: Jürgen Sleven, Kempen, Fed. Rep. of Germany

[73] Assignee: Hans Sleven GmbH & Co. Kunststoff-und Verpackungs KG, Kempen, Fed. Rep. of Germany

[21] Appl. No.: 753,036

[22] Filed: Aug. 30, 1991

[51] Int. Cl.[5] ..... B65D 33/30

[52] U.S. Cl. ..... 24/30.5 R

[58] Field of Search ..... 383/71, 70, 905; 24/30.5 R, 30.5 P, 30.5 T; 206/345, 340, 820

[56] References Cited

U.S. PATENT DOCUMENTS 2,049,030 7/1936 Strauss ..... 206/820 X

FOREIGN PATENT DOCUMENTS 771673 2/1972 Belgium .
092504 2/1967 Fed. Rep. of Germany .
2203543 8/1973 Fed. Rep. of Germany .
7344679 5/1974 Fed. Rep. of Germany .
2362598 6/1975 Fed. Rep. of Germany .
2606658 9/1977 Fed. Rep. of Germany .
2605671 9/1979 Fed. Rep. of Germany .

*Primary Examiner*—James R. Brittain
*Attorney, Agent, or Firm*—Marmorek, Guttman & Rubenstein

[57] ABSTRACT

A clip closure for bags, more particularly a band consists of such clip closures which can be processed in a bag-closing machine. The clip closure takes the form of a flat, elongate strip 1 having reinforced longitudinal edges. The strip 1, together with its reinforced longitudinal edges 2, 3, is made entirely of a flexible plastics. To reinforce the longitudinal edges 2, 3 the strip 1 is thicker at the longitudinal edges than in the zone therebetween. At two places spaced out from one another and from its ends the strip is weakened over its entire width to form required bending folds 12, 13, the reinforced longitudinal edges 2, 3 having cutaway portions 6–9 at said places.

9 Claims, 1 Drawing Sheet

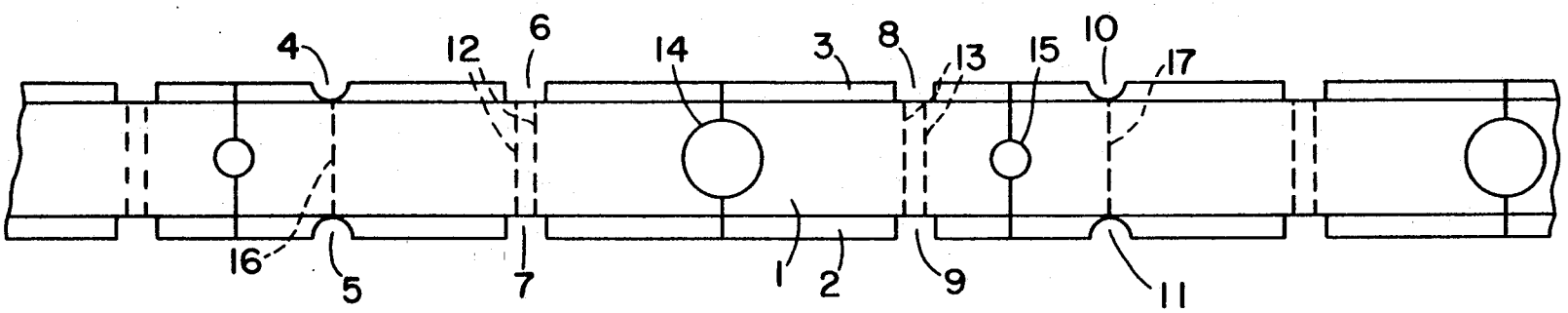
17
10
15
13
8
3
14
6
12
4
16
11
9
2
1
7
5

CLIP CLOSURE FOR BAGS

The invention relates to a clip closure for bags, in the form of a flat, elongate strip of flexible plastics having reinforced longitudinal edges.

Clip closures of the kind specified are known in the form of individual closures by means of which bags can be closed manually, or in the form of a band which can be cut to length in a bag-closing machine. The longitudinal edges of both the individual closures and the closures which can be cut to length from the band have embedded wires for their reinforcement. The purpose of the wires is to hold the closure together against the return forces of the otherwise plastics strip after the end portions of the closure have been folded over. These prior art clip closures have a number of disadvantages:

1. The wires embedded in their edges make these clip closures expensive to manufacture.
2. The blades of the bag-closing machine which cut the band to length must be designed to neatly sever not only the plastics strip but also the wires.
3. Foodstuffs, for example, bread, cannot be sterilized by microwaves if the foodstuffs are contained in a bag closed by a clip closure having a wire insert.

It is an object of the invention to provide a clip closure for bags which is inexpensive to manufacture, can readily be applied to a bag, keeps the bag reliably closed and can also be exposed to microwave radiation with no adverse effect on its function.

This problem is solved according to the invention in a clip closure of the kind specified by the features that the strip, including its reinforced longitudinal edges, is made entirely of plastics, the longitudinal edges being constructed thicker than the zone therebetween, and at two places spaced out from one another and from its ends the strip is weakened over its entire width to form required bending folds, the reinforced longitudinal edges having cutaway portions at said places.

The clip closure according to the invention is insensitive to treatment with microwaves, so that a bag closed with such a closure remains reliably closed. The cutaway portions at the reinforced longitudinal edges and the weakening of the strip between the longitudinal edges at the required bending folds ensure that the strip can be readily folded over flat, so that a bag closed in this way is effectively closed. Tests carried out on such a clip closure made from a copolymer, more particularly polypropylene, having low return forces have proved completely satisfactory.

According to a first feature of the invention the strip has between one end and the adjacent place for the required bending fold and the reinforced longitudinal edges a hole for a patch of glue or a clamping pin. The closure effect can be further boosted by introducing adhesive via the hole following closure. The same effect can also be achieved by the use of a clamping pin which can be inserted through the hole and glued or welded on to the subjacent part of the strip. This second alternative also enables the closure to be opened and reclosed.

The clip closure according to the invention is also particularly suitable for being processed on machines. To enable the closure to be processed in a bag-closing machine, according to one feature of the invention the clip closure forms a portion of a band which is formed by a number of immediately succeeding identical closures and is formed at regular distances, adapted to the length of the closures, with conveying means, more particularly holes, for a bag-closing machine. In this way the individual closure can be advanced in the correct rhythm via the holes for cutting to length and folding. To obtain a neat cut when cutting to length and/or to allow operation with very simple cutting tools, according to another feature of the invention the reinforced longitudinal edges have cutaway portions at required parting places between successive closures.

The invention will now be described in greater detail with reference to a drawing presenting a view of a component length of a band comprising a number of clip closures.

The band consists of a flat, elongate strip 1 having reinforced longitudinal edges 2, 3. The strip 1, together with its longitudinal edges 2, 3, is made entirely of flexible plastics. A copolymer, more particularly polypropylene, has been found to be suitable. The plastics must have properties such that it can be folded and after folding generates as low return forces as possible and offers a certain resistance to backward bending.

The reinforced longitudinal edges 2, 3 are obtained by the strip 1 being thicker at the edges than in the central zone. At predetermined opposite places the reinforced longitudinal edges 2, 3 have cutaway portions 4–11 which can be semi-circular or angular. The central zone of the strip 1 between the cutaway portions 6 and 7 and also 8 and 9 is also weakened over its entire width, for example, by notching, to form required bending folds 12, 13. Such weakenings are not provided at the places between the cutaway portions 4, 5 or 10, 11. In this zone at the required parting place 16, 17 indicated by a chain dot line the bag-closing machine parts one closure from the next closure.

To enable the closures of a band to be conveyed with the correct dimensions, the strip 1 is formed with a hole 14 in which a conveying pin of the bag-closing machine can engage. Of course, the hole 14 need be provided only if it is required by the bag-closing machine. Naturally, the hole 14 is not required for individual closures. However, the bag-closing machine might also be so designed as to convey the closures with the correct dimensions by using the cutaway portions 4–11.

In the case of both individual closures and closures combined into a band, one of the portions to be folded over can be formed with a hole 15 via which a patch of glue can be introduced to reach the subjacent zone of the folded closure. However, a pin can also be introduced into the hole 15 and connected to the subjacent part of the folded-over closure. While in the former case the closure is non-releasably connected, in the latter case the closure can be opened and reclosed.

I claim:

1. A clip closure band comprising a flat elongate strip of flexible plastic material divided by a plurality of predetermined parting places into a plurality of successive clip closure blanks suitable for closing bags, said strip having reinforced longitudinal edges which are thicker than a zone lying between said longitudinal edges, each of said closure blanks being made exclusively from said plastic material, each of said closure blanks including predetermined bending folds extending across the width of said band, said bending folds being spaced apart from said parting places and from each other.

2. The clip closure band of claim 1 further comprising cut-outs along said longitudinal edges and in line with said bending folds.

3. The clip closure band of claim 1 wherein each of said closure blanks includes a hole between one of its parting places and one of its bending folds, said hole being suitable for receiving adhering means.

4. The clip closure band of claim 3 wherein said adhering means comprises an adhesive tag.

5. The clip closure band of claim 3 wherein said adhering means comprises a clamping pin.

6. The clip closure band of claim 1 further comprising conveying means disposed along said strip.

7. The clip closure band of claim 6 wherein said conveying means comprises holes disposed at regular intervals along said strip.

8. The clip closure band of claim 1 further comprising cut-outs disposed along said longitudinal edges and in line with said parting places.

9. The clip closure band of claim 1 wherein said plastic material is a polypropylene copolymer.

* * * * *